United States Patent [19]

Ellis et al.

[11] 4,374,049

[45] Feb. 15, 1983

[54] ZINC OXIDE VARISTOR COMPOSITION NOT CONTAINING SILICA

[75] Inventors: Howard F. Ellis, Stephentown, N.Y.; Herbert Fishman, Pittsfield, Mass.

[73] Assignee: General Electric Company

[21] Appl. No.: 157,097

[22] Filed: Jun. 6, 1980

[51] Int. Cl.[3] ..... H01B 1/06

[52] U.S. Cl. ..... 252/519; 252/518; 338/20; 338/21

[58] Field of Search ..... 252/518, 519, 521; 338/20, 21

[56] References Cited

U.S. PATENT DOCUMENTS

| | | | |
|---|---|---|---|
| 3,928,242 | 12/1975 | May | 252/518 |
| 3,928,245 | 12/1975 | Fishman | 252/518 |
| 3,953,373 | 4/1976 | Matsuura et al. | 252/518 |
| 3,999,159 | 12/1976 | Matsugua et al. | 252/518 |
| 4,038,217 | 7/1977 | Nambu et al. | 252/518 |
| 4,045,374 | 8/1977 | Nagasawa et al. | 252/518 |
| 4,046,847 | 9/1977 | Kresge | 252/518 |

*Primary Examiner*—J. L. Barr

*Attorney, Agent, or Firm*—Robert A. Cahill

[57] ABSTRACT

Zinc oxide varistors having high resistance and exponent values are fabricated from a composition consisting essentially of the oxides of zinc, tin, bismuth, antimony, manganese, nickel, cobalt and boron. The composition does not contain barium oxide or silicon dioxide and still retains long term stability properties.

4 Claims, No Drawings

ZINC OXIDE VARISTOR COMPOSITION NOT CONTAINING SILICA

BACKGROUND OF THE INVENTION

U.S. Pat. No. 3,764,566 teaches the addition of silicon dioxide to zinc oxide varistors along with barium oxide for the purpose of obtaining a high exponent and a high resistance.

U.S. Pat. No. 3,928,245 discloses that instability problems occur when silica is used as a zinc oxide varistor composition additive. The latter patent improves over the former by disclosing the addition of equimolar concentrations of the oxides of barium and boron in order to enhance long term varistor stability without causing a decrease in either the varistor exponent or resistance.

It has since been determined that varistors containing the oxides of silicon, boron, and barium, contain a higher watts loss value than varistors not containing silica. It has heretofore been impossible to manufacture zinc oxide varistors for lightning arrester applications, without the addition of silica and still maintain a high exponent and high resistance. Varistors having a high watts loss value must be provided with sufficient heat sink material to ensure that they do not become overheated during a surge voltage condition and be driven into a condition known as "thermal runaway". Since varistors, in station arrester applications, are continuously subjected to a leakage current, the amount of varistor watts loss is an important design consideration.

The purpose of this invention is to provide a varistor composition having low watts loss and good long term stability without decreasing the exponent or resistance.

SUMMARY OF THE INVENTION

The invention comprises a zinc oxide varistor composition having low watts loss, good long term thermal stability, high exponent and high resistance without the addition of the oxides of silicon and barium. In accordance with the present invention, there is provided a zinc oxide varistor composition comprising: ZnO as a major constituent; equimolar concentrations of the oxides of Bi, Co, Mn and Sn; and the oxides of Sb, Ni and B wherein the quantity of Ni is less than Sb and greater than B. One such composition comprises 95 mole percent ZnO, 2.0 mole percent $Sb_2O_3$, 1.0 mole percent NiO, 0.01 mole percent $B_2O_3$, and 0.5 molar percent each of $SnO_2$, $Bi_2O_3$, $MnO_2$, and $Co_2O_3$.

DESCRIPTION OF THE PREFERRED EMBODIMENTS

The zinc oxide varistor of the invention is prepared in a manner similar to that described within aforementioned U.S. Pat. No. 3,928,245 wherein a powder having the composition A listed in the following Table, was pressed into a plurality of zinc oxide disks and sintered into a uniform mass at a temperature in excess of 1000° C. After sintering, electrode layers are applied to opposing faces of the disk and a glass or ceramic insulating collar is applied to the rim.

For comparison purposes, a plurality of disks were made having the composition B in a similar manner to that disclosed in the aforementioned U.S. Pat. No. 3,928,245.

TABLE I

| | TYPE A | TYPE B |
|---|---|---|
| ZnO | 96.53 | 95.0 |
| $Bi_2O_3$ | 0.50 | 0.50 |
| $Co_2O_3$ | 0.50 | 0.50 |
| $MnO_2$ | 0.50 | 0.50 |

TABLE I-continued

| | TYPE A | TYPE B |
|---|---|---|
| $Sb_2O_3$ | 1.00 | 2.00 |
| $Cr_2O_3$ | 0.50 | |
| NiO | 1.00 | 1.00 |
| $SnO_2$ | | 0.50 |
| BaO | 0.10 | |
| $B_2O_3$ | 0.10 | 0.05 |
| $SiO_2$ | 0.10 | |
| n(100A-10KA) | 28.4 | 30.3 |
| n(5MA-100A) | 45.0 | 52.2 |
| W(0.8V at 5MA) | 0.633 | 0.295 |
| K(volts/mm) | 220 | 250 |

The electrical properties of the varistors having compositions A and B are defined by the equation $I=(V/K)^n$ wherein I is the current through the varistor, K is a constant corresponding to the resistance, V is the voltage across the resistor, and n is the exponent indicating the degree of non-linearity. The watts loss value, designated W, is the amount of watts dissipated by the varistor with an impressed voltage of 0.8 times the voltage at 50 milliamperes varistor current. The two values of the exponent n are determined one from the voltage range of 5 MA to 100 A and another from the voltage range of 100 A to 10 KA. The constant K is determined by dividing the voltage at 1 amperes by the thickness of the disk.

In order to determine the long term stability of the varistors, the varistors were placed in an oven, maintained at a temperature of 115° C. An alternating voltage was applied to each of the disks sufficient to mantain a current density of 0.04 milliamperes per square centimeter and was maintained at a constant value. To determine the long range stability the watts loss was read over various periods of time to determine the rate of increase. The faster the rate of watts loss increase, for example, the more unstable the varistor disk. As described in the aforementioned patent 3,928,245, varistors having the composition A containing equimolar concentrations of the oxide of barium and boron together with 0.25 mole percent $SiO_2$, exhibited substantially improved stability over compositions similar to that of A but not containing these oxides. For long term stable disks having the composition of the invention, the molar concentration of $Sb_2O_3$ should be present in amounts greater than NiO, the concentrations of $Bi_2O_3$, $CoO_3$, $MnO_2$ and $SnO_2$ should each be less than NiO and the $B_2O_3$ should be present in the smallest amount, preferably less than 0.10 mole percent.

What we claim as new and desire to secure by Letters Patent of the United States is:

1. A zinc oxide varistor composition free of the oxides of silicon and barium, comprising:

ZnO as a major constituent;

equimolar concentrations of about 0.5 mole percent of each of the oxides of Bi, Co, Mn, and Sn; and about 2.0 mole percent of the oxide of Sb, about 1.0 mole percent of the oxide of Ni, and about 0.01 to about 0.10 mole percent of the oxide of B wherein the quantity of Ni is less than Sb and greater than B.

2. The composition of claim 1 wherein zinc oxide is 95 mole percent.

3. The composition of claim 1 wherein the oxide of B is about 0.05 mole percent.

4. A zinc oxide varistor composition free of the oxides of silicon and barium, comprising:

0.50 mole percent of the oxides of Bi, Co, Mn and Sn;

2.00 mole percent of the oxide of Sb;

1.00 mole percent of the oxide of Ni; and about 0.01 to about 0.10 mole percent of the oxide of B, the remainder consisting essentially of zinc oxide.

* * * * *